United States Patent [19]

Hollett et al.

[11] 4,144,000

[45] Mar. 13, 1979

[54] FUEL PUMPING APPARATUS

[75] Inventors: Reginald Hollett, Rochester; Robert T. J. Skinner, High Wycombe, both of England

[73] Assignee: Lucas Industries Limited, Birmingham, England

[21] Appl. No.: 870,874

[22] Filed: Jan. 20, 1978

[30] Foreign Application Priority Data

Jan. 28, 1977 [GB] United Kingdom ..... 3472/77

[51] Int. Cl.[2] ..... F04B 29/00

[52] U.S. Cl. ..... 417/462

[58] Field of Search ..... 91/491; 417/462

[56] References Cited

U.S. PATENT DOCUMENTS 3,267,861 8/1966 Pigeroulet et al. ..... 91/491

FOREIGN PATENT DOCUMENTS 1383466 2/1975 United Kingdom ..... 417/462

*Primary Examiner*—William L. Freeh

[57] ABSTRACT

A fuel injection pumping apparatus includes a pair of plungers which are reciprocable within a bore formed in a rotary distributor member. The apparatus is required to provide fuel for a five cylinder engine and surrounding the distributor member is a cam ring which has five equiangularly spaced inwardly extending cam lobes. One of the plungers is engaged by a shoe which mounts a roller for engagement with the cam lobes in turn whilst the other plunger is engaged by a member which mounts a pair of rollers which are spaced by an amount such that they will engage at the same time, an adjacent pair of cam lobes. In this manner both plungers are moved inwardly at the same time five times at each revolution of the distributor member.

8 Claims, 6 Drawing Figures

FUEL PUMPING APPARATUS

This invention relates to fuel injection pumping apparatus for supplying fuel to an internal combustion engine and of the kind comprising a body part, a rotary member mounted within the body part and arranged in use to be driven in timed relationship with the associated engine, a pair of plungers mounted in a transversely extending bore in the rotary member, an annular cam ring mounted within the body part, cam lobes angularly positioned about the internal periphery of the cam ring, roller means positioned intermediate the plungers and the cam, passage means for conveying fuel displaced from the bore to a plurality of outlets in turn during successive inward displacements of the plungers and further passage means for supplying fuel to the bore.

The object of the invention is to provide such an apparatus in a form capable of supplying fuel to a five cylinder engine.

According to the invention an apparatus of the kind specified for supplying fuel to a five cylinder engine is provided with five cam lobes equiangularly spaced about the rotary member, and said roller means comprises a first roller mounted in a shoe acting on one of said plungers, the other plunger being engaged by a member extending generally transversely of the axis of movement of the plunger, said member being operated by a pair of rollers which are spaced apart by an amount such that they engage a pair of adjacent cam lobes whereby the plungers will be moved inwardly five times per revolution of the rotary member.

Two examples of a fuel pumping apparatus in accordance with the invention will now be described with reference to the accompanying drawings in which.

Figure 1:
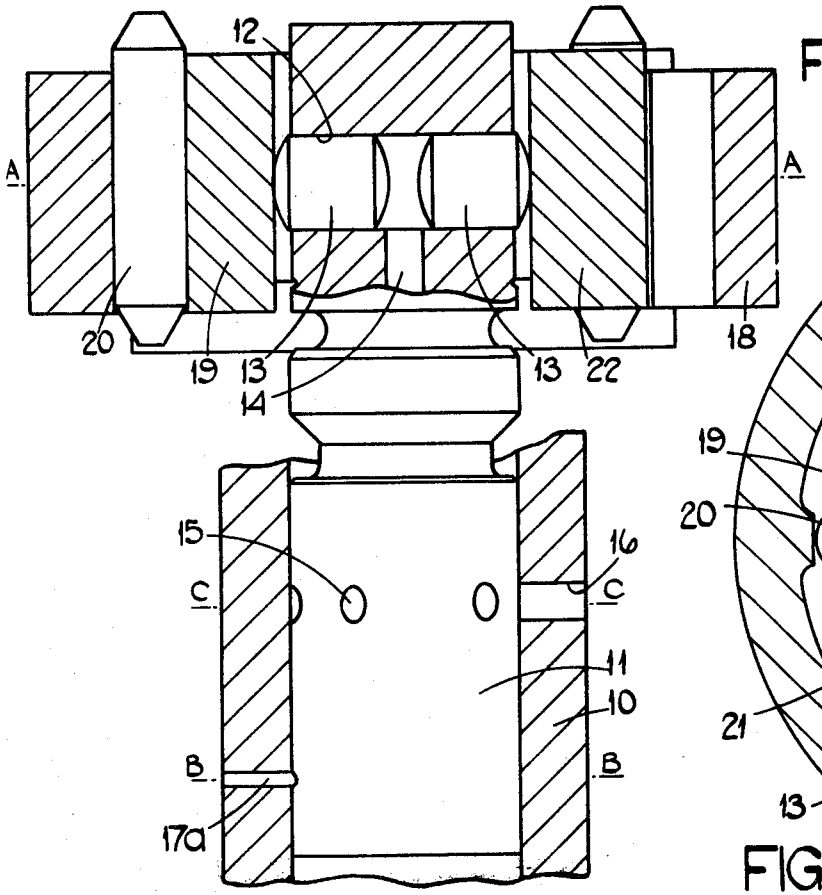
FIG. 1 shows in sectional side elevation, part of one example of the apparatus.

Referring to FIGS. 1, 2, 3 and 4 of the drawings the apparatus comprises a body member 10 in which is mounted a rotary distributor member 11. The distributor member 11 in use, is rotated in timed relationship with the associated engine, and formed in the distributor member is a transversely extending bore 12 which mounts a pair of pumping plungers 13. The bore 12 and the space between the plungers 13 defines a pumping chamber which communicates with a longitudinally extending passage 14 formed in the distributor member. At one point this passage communicates with five equiangularly spaced inlet passages 15 which open onto the periphery of the distributor member and which register in turn with an inlet port 16 formed in the body part 10. The passage 14 also communicates with a delivery passage 17 extending to the periphery of the distributor member and which is arranged to register in turn as the distributor member rotates, with outlet ports **17*a*** formed in the body part and communicating respectively with the injection nozzles of the associated engine.

There are provided five outlet ports **17*a* and also five inlet passage 15**.

Figure 2:
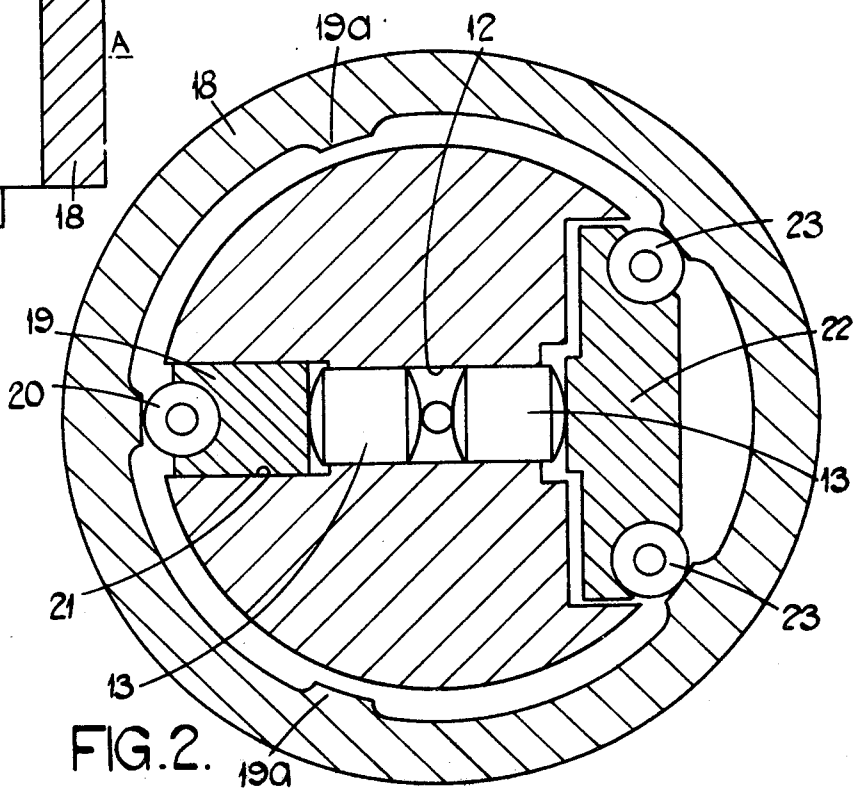
FIG. 2 is a sectional end elevation generally on the line AA of FIG. 1.
Figure 3:
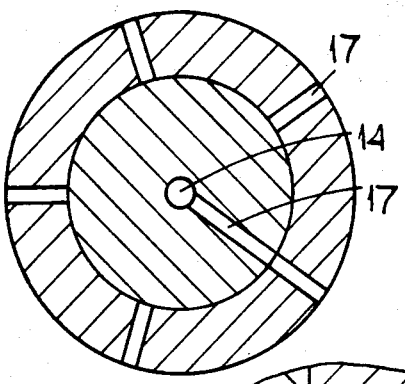
FIGS. 3 and 4 are sections on the lines BB and CC of FIG. 1.
Figure 4:
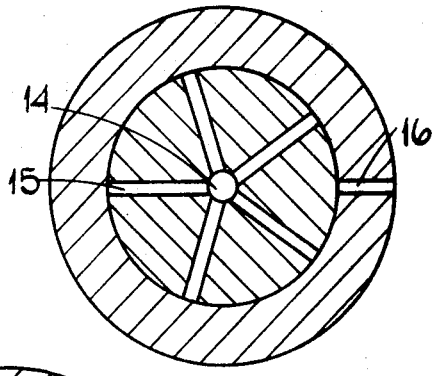
Figure 4:
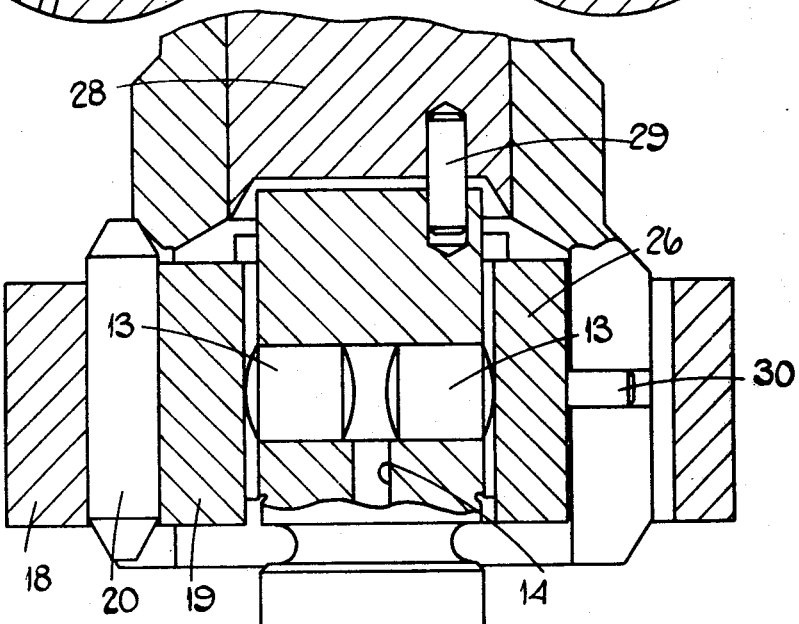

Surrounding the rotary member is an annular cam 18. This is located within the body part 10 and may be permitted limited angular movement to enable the timing of delivery of fuel to be varied. As seen in FIG. 2 five cam lobes **19*a* are formed on the internal periphery of the cam 18**, the cam lobes being equiangularly spaced.

Associated with one of the plungers 13 is a shoe 19 which carries a roller 20. The shoe 19 is accommodated within a slot 21 formed in an enlarged portion of the distributor member 11 and the axis of movement of the shoe coincides with the axis of movement of the associated plunger. As the distributor member rotates therefore the plunger will be moved radially inwards when the roller 20 engages a cam lobe.

The other plunger is engaged by a member 22 which is also housed within the distributor member and which is provided at its ends, with a pair of recesses which mount a pair of rollers 23. The spacing of the rollers 23 is such that they engage as the distributor member rotates, a pair of adjacent cam lobes **19*a* thereby resulting in inward movement of the member 22 and inward movement of the associated plunger. In operation, when the inlet port 16 is in register with an inlet passage 15 fuel flows to the bore 12 to effect outward movement of the plungers and also the shoe 19 and the member 22. During continued rotation of the distributor member, the inlet passage 15 moves out of register with the inlet port 16 and the outlet passage 17 moves into register with one of the outlets 17*a*. Moreover, whilst this latter communication is established the plungers 13 are moved inwardly by the action of the rollers and cam lobes. As a result of such inward movement fuel is displaced from the bore 12 and flows to the outlet 17*a* which is in communication with the passage 17**. Thereafter the process is repeated. Each time the distributor member rotates the plungers will be moved inwardly five times so that each injection nozzle of the associated engine will receive a quantity of fuel once per revolution of the distributor member.

It will be noted that since only two plungers are provided then the loading on the distributor member is in theory balanced. However, it will be noted that the paths of movement of the pair of rollers 23 are parallel to but spaced from the path of movement of the associated plunger 13 whereas the path of movement of the roller 20 corresponds with the path of movement of the associated plunger. This latter path of movement is of course radial. As a result there will be a difference between the contact angle of the roller 20 and a cam lobe and the contact angle of the rollers 23 with the cam lobes. It is likely therefore that there will be a difference in the motion of the two plungers and possibly some loading of the distributor member.

Figure 5:
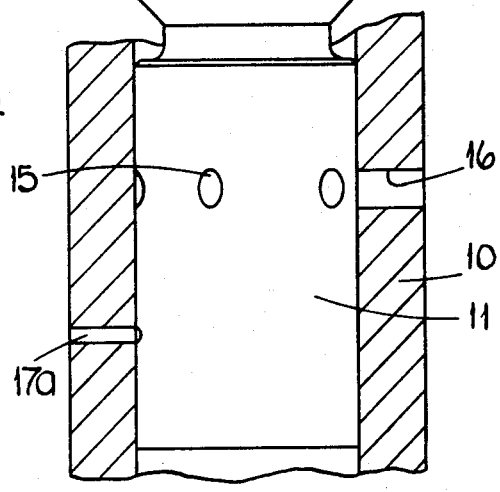
FIG. 5 is a view similar to FIG. 1 of the second example of the apparatus.
Figure 6:
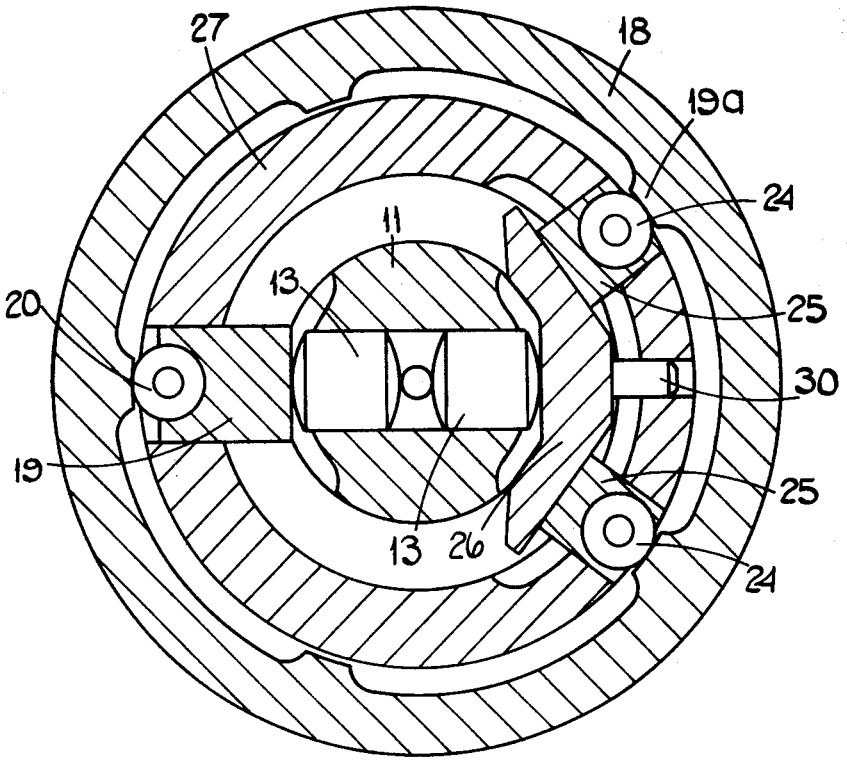
FIG. 6 is a view similar to FIG. 2 again of the second example of the apparatus.

This disadvantage is overcome by the arrangement which is shown in FIGS. 5 and 6.

Turning to FIGS. 5 and 6 identical reference numerals are utilised wherever this is possible. The shoe 19 and the associated roller 20 are provided as before however, the pair of rollers now referenced 24, are each mounted in shoes 25 which are constrained to move radially by means to be described. The shoes 25 have flat surfaces which engage with flat surfaces on a member 26. The surfaces are normal to the radii extending through the respective rollers 24. The member 26 engages with the other plunger 13. During rotation of the distributor member 11 therefore all the rollers move radially so that the contact angles between the rollers and cam lobes are the same. The transverse member 26 does move radially along a path coinciding with the axis of the bore. As a result limited slip does take place between the aforesaid surfaces of the shoes 25 and the member 26.

In the arrangement shown in FIGS. 1 and 2 the shoe 19 and the transverse member 22 are driven from the distributor member which is specially enlarged. In the arrangement shown in FIGS. 5 and 6 however, the shoe 19 together with the shoes 25 are located in slots respectively formed in a cup-shaped driving member 27. The driving member 27 is secured to a drive shaft 28 and a pin 29 extends between the drive shaft 28 and the distributor member 11 to transmit rotary motion therebetween. Moreover, the transverse member 26 is provided with a pin 30 which is accommodated within a further slot formed in the cup-shaped member 27. In this manner the distributor member is relieved entirely of any loading due to the reaction of the rollers and the cam lobes. Moreover, the forces applied to the plungers 13 are substantially equal so that there is substantially no side thrust on the distributor member.

We claim:

1. A fuel injection pumping apparatus for supplying fuel to an internal combustion engine and of the kind comprising a body part, a rotary member mounted within the body part and arranged in use to be driven in timed relationship with the associated engine, a pair of plungers mounted in a transversely extending bore in the rotary member, an annular cam ring mounted within the body part, cam lobes angularly positioned about the internal periphery of the cam ring, roller means positioned intermediate the plungers and the cam, passage means for conveying fuel displaced from the bore to a plurality of outlets in turn during successive inward displacements of the plungers and further passage means for supplying fuel to the bore, characterised in that for supplying fuel to a five cylinder engine, five cam lobes are equiangularly spaced about the rotary member and said roller means comprises a first roller mounted in a shoe acting on one of said plungers, the other plunger being engaged by a member extending generally transversely of the axis of movement of the plunger, said member being operated by a pair of rollers which are spaced apart by an amount such that they engage a pair of adjacent cam lobes whereby the plungers will be moved inwardly five times per revolution of the rotary member.

2. An apparatus according to claim 1 in which said member defines a pair of recesses at its ends respectively, and a pair of rollers mounted in said recesses, said rollers during inward movement of the associated plunger, moving substantially parallel to the axis of movement of the plunger.

3. An apparatus according to claim 2 in which said shoe and said member are located in an enlargement of the distributor member.

4. An apparatus according to claim 1 including an annular member surrounding the distributor member and rotatable therewith, a first radial slot formed in said annular member for locating said shoe for radial movement, a pair of spaced second radial slots formed in said annular member, a pair of shoes in said second slots respectively, said pair of shoes mounting said pair of rollers respectively and engaging said member which engages said other plunger.

5. An apparatus according to claim 4 in which said annular member and said distributor member are separately coupled to a drive shaft.

6. An apparatus according to claim 4 in which said shoes define flat surfaces for engagement with flat surfaces formed on said member, said surfaces being normal to the radii extending through the respective rollers.

7. An apparatus according to claim 6 in which said member which engages said other plunger and said annular member are provided with a pin and slot connection which transmits rotary motion between said members.

8. An apparatus according to claim 7 in which the axis of said pin and slot connection is aligned with the axis of said other plunger.

* * * * *